United States Patent [19]

Klein et al.

[11] 3,942,342

[45] Mar. 9, 1976

[54] APPARATUS FOR DYEING AND PRINTING MATERIALS

[75] Inventors: Norman E. Klein, Inman; William H. Stewart, Jr., Spartanburg, both of S.C.

[73] Assignee: Deering Milliken Research Corporation, Spartanburg, S.C.

[22] Filed: May 17, 1974

[21] Appl. No.: 471,110

[52] U.S. Cl. ..... 68/205 R

[51] Int. Cl.[2] ..... D06B 1/02

[58] Field of Search ..... 68/205 R; 15/312 R; 134/166 C, 167 C, 168 C, 169 C; 239/112, 186

[56] References Cited

UNITED STATES PATENTS

| | | | |
|---|---|---|---|
| 2,218,811 | 10/1940 | Chaussabel | 68/205 R |
| 3,271,102 | 9/1966 | Morgan | 68/205 R |
| 3,570,275 | 3/1971 | Weber et al. | 68/205 R |
| 3,688,530 | 9/1972 | Harris | 68/205 R |

*Primary Examiner*—Richard E. Aegerter
*Assistant Examiner*—L. Footland
*Attorney, Agent, or Firm*—Luke J. Wilburn, Jr.; H. William Petry

[57] ABSTRACT

Apparatus to apply dyes to a moving sheet of material to print the same which employs dye applicator gun bars constructed to facilitate and maintain accurate alignment of the applicator jets of the gun bars across the length of the bars wherein the fluid supplying manifolds for the jets are incorporated to provide structural support and stability to the applicator system.

7 Claims, 10 Drawing Figures

APPARATUS FOR DYEING AND PRINTING MATERIALS

This invention relates to the application of dyestuffs to textile materials and, more particularly, to the printing of textile fabrics having relatively porous surfaces, such as pile carpets.

Textile fibers and fabric materials have long been colored with natural and synthetic dyes, and, in particular, printed by color decoration of the surface or surfaces of the materials in definite repeated forms and colors to form a pattern. The color printing of textile fabrics has been accomplished in various ways. Earlier forms of printing used carved blocks charged with colored paste pressed against the fabric. Subsequently, speed of printing has been increased by the development of roller printing wherein moving fabrics are sequentially contacted by engraved metal rollers each containing a different color dye to form the desired pattern thereon. Textile fabrics are also printed by sequential contact with screens each having a porous portion of a pattern and carrying a particular color dyestuff.

More recently, it has been proposed to print textile fabrics, including pile carpets, by the programmed spraying or jetting of plural colored dyes onto the surface of a moving fabric. Typical of such processes and apparatus are described in U.S. Pat. Nos. 3,443,878; 3,570,275; and British Pat. No. 978,452. Generally, such apparatus consists of a plurality of dye applicator bars spaced along the direction of movement of the textile material and each containing multiple dye nozzles or jets extending transversely across the moving material. Each jet may be activated by suitable electric, pneumatic, or mechanical means to dispense dyes onto the moving material in a desired sequence, and pattern control of the jets may be accomplished by suitable programming means, such as coded punch tapes, magnetic tapes, computers, and the like.

U.S. Pat. Nos. 3,443,878 and 3,570,275 disclose specific means for applying streams of dyes to print a fabric by use of continuously flowing streams of dyes which are deflected by a stream of air to either impinge the dyestream upon the fabric or recirculate it to a reservoir. Control of such systems to form printed patterns may be accomplished by various of the aforementioned programming and control means.

In order to provide a greater variety of colors or shades of colors to the fabrics by use of such spray printing apparatus, it has also been proposed to apply different colors to the same locations or areas of the fabric to thereby blend primary colors in situ.

It can be appreciated that in the application of different colored dyes to the surface of textile fabrics, it is extremely important to accurately place each dyestuff on the fabric, particularly when intricate patterns are being printed and when in situ blending is employed. In dyeing relatively porous textile fabrics, such as pile carpets, it is also important that a carefully controlled amount of dye be applied to each dyed area on the pile surface to ensure optimum penetration of the dye color to the depth of the pile fiber without undesirable spread of the color into adjacent areas of the fabric. U.S. Pat. No. 3,393,411 discusses such a problem of dye penetration of pile carpet and suggests controlling the flow rate of the dyestuff and the speed of movement of the pile carpet past the dye application point to provide the desired amount of dye to the carpet.

In printing pile carpets with detailed patterns of colors, it can be appreciated that the dye jet applicators are very closely spaced relative to each other to permit dyeing in fine detail on the pile surface. The mounting, construction or programmed control of various gun bars for application of various dyestuffs to moving webs are also disclosed in one or more of British Pat. Nos. 1,201,598; 1,201,600; 1,201,599; and 1,202,345.

Also, in the pattern printing of wide yardage goods of continuous lengths, such as pile carpets wherein the widths being printed may be as much as 15 feet, it can be appreciated that it is highly desirable and necessary that the dye applicator gun bars be well supported and accurately aligned throughout their lengths to ensure accurate and proper placement of the jets of dye being applied across the entire width of the goods being printed. One such design and arrangement of gun bar construction is disclosed in commonly assigned copending U.S. Pat. application Ser. No. 430,527, filed Jan. 3, 1974.

The present invention is concerned with further improvements in apparatus for the jet printing of textile products including pile fabrics to facilitate accurate placement of desired amounts of dyes at specific locations on or in the surface of the pile fabrics to improve pattern definition in such fabrics. More specifically, the present invention is directed to a unique dye applicator gun bar construction utilized in such apparatus to apply multiple streams or jets of dyestuff across the width of a moving textile material to be printed.

The invention will be better understood by reference to the accompanying drawings which disclose a specific embodiment, and wherein.

Figure 5:
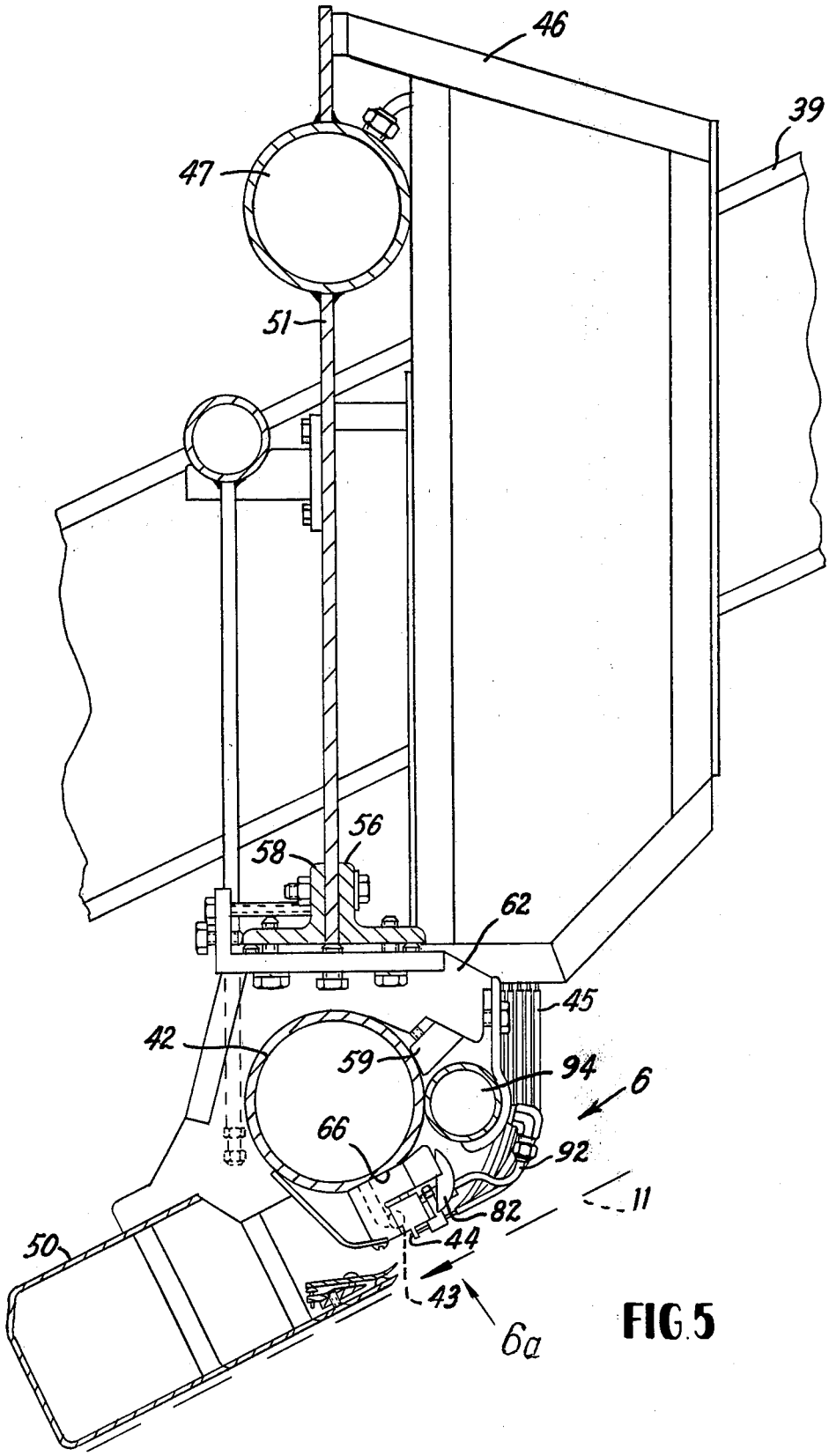
FIG. 5 is a side elevation view, with portions in section, of the gun bar of FIG. 3.
Figure 6:
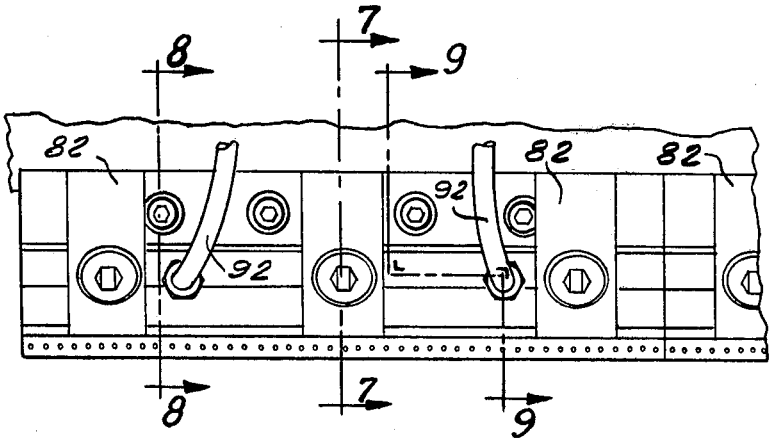
FIG. 6 is an enlarged view of a portion of the dye jet applicator section of the gun bar, looking in the direction of arrow 6 of FIG. 5, with portions broken away and removed to better show the mounting means for the dye jet applicator section and the associated air deflection means.
Figure 6A:
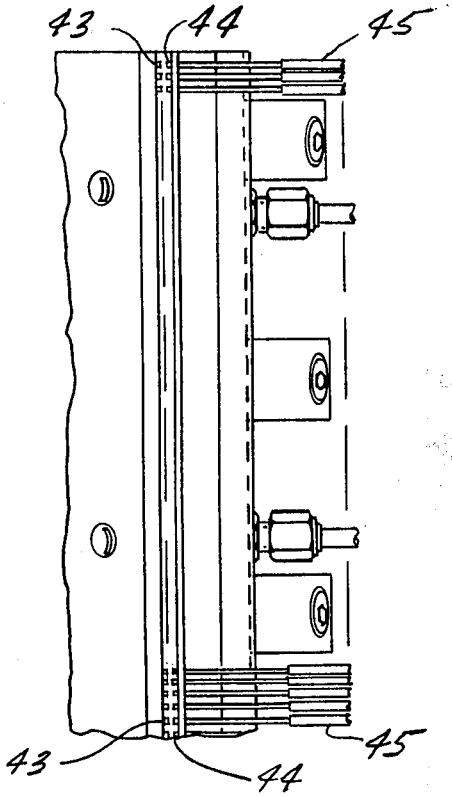
Figure 7:
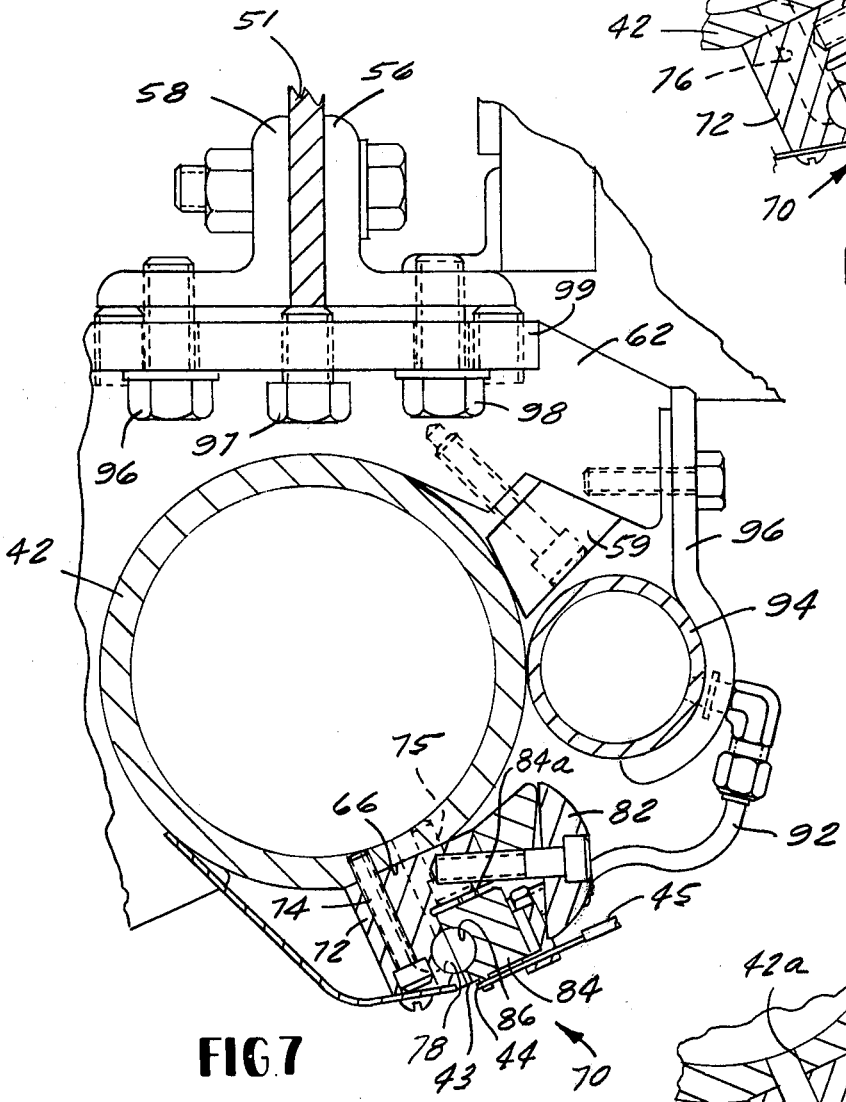
Figure 8:
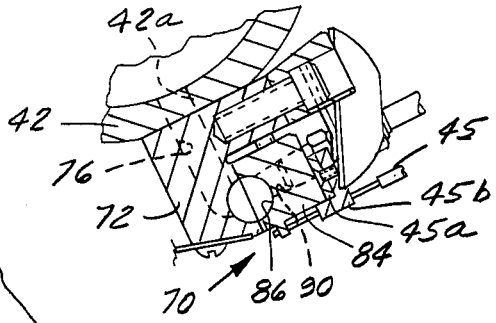
Figure 9:
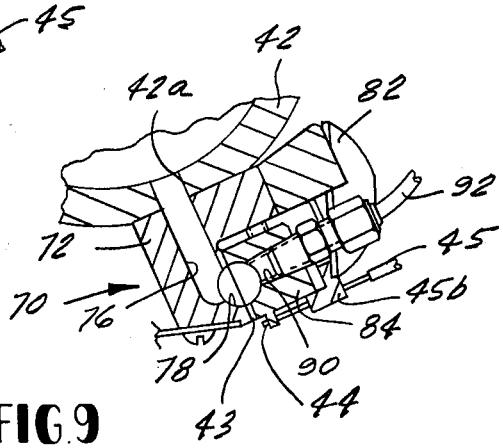

FIG. 6*a* is an enlarged view of a portion of the dye jet applicator section of the gun bar, looking in the direction of the arrow 6*a* of FIG. 5 and showing the dye jet orifices and their associated air supply conduits for deflecting the dye streams;

FIG. 7 is an enlarged sectional view of the manifold and jet dye applicator section of the gun bar of FIG. 5, taken generally along line 7—7 of FIG. 6;

FIG. 8 is an enlarged sectional view of a portion of the gun bar, taken generally along line 8—8 of FIG. 6; and FIG. 9 is an enlarged sectional view of a portion of the gun bar, taken generally along line 9—9 of FIG. 6.

Figure 1:
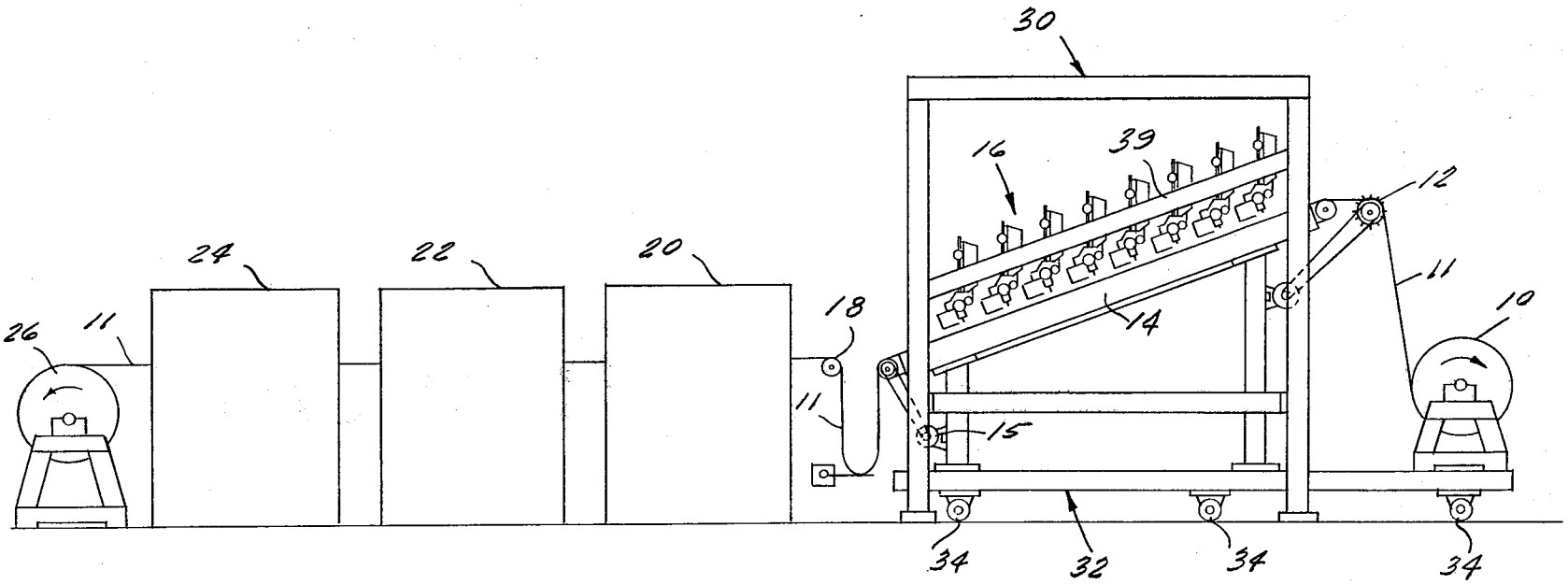
FIG. 1 is a schematic side elevation of an apparatus for the jet dyeing of textile materials.

Referring more specifically to the drawings, FIG. 1 shows a jet dyeing apparatus for color printing of moving materials, such as textile fabrics including pile carpets, tiles, and the like. As shown and described, the apparatus consists of a fabric supply source such as a tufted carpet roll 10 from which a continuous length of pile carpet 11 is drawn by a driven pin roller 12 and is delivered onto an inclined conveyor 14 which is driven by suitable motor means 15 to convey the carpet 11 beneath a dye applicator gun bar section 16, each gun bar of which dispenses plural streams of dye onto the carpet during its passage. The gun bars may be provided with different colored dyes and each of the plural streams of dye is programmed in suitable manner so as to apply the dyes to the surface of the carpet in a desired pattern.

The printed carpet leaving the conveyor 14 is directed by suitable conveying means, such as guide rolls 18, sequentially through a steam chamber 20, a water washer 22, and a dryer 24 where the printed carpet is treated in conventional manner to fix the dyes, remove excess dye, and dry the printed carpet, respectively. The carpet is then collected on a roll 26. Details of the dye fixing steam chamber, washer, and dryer do not form a part of the present invention and conventional apparatus for performing such conventional practices may be employed.

Figure 2:
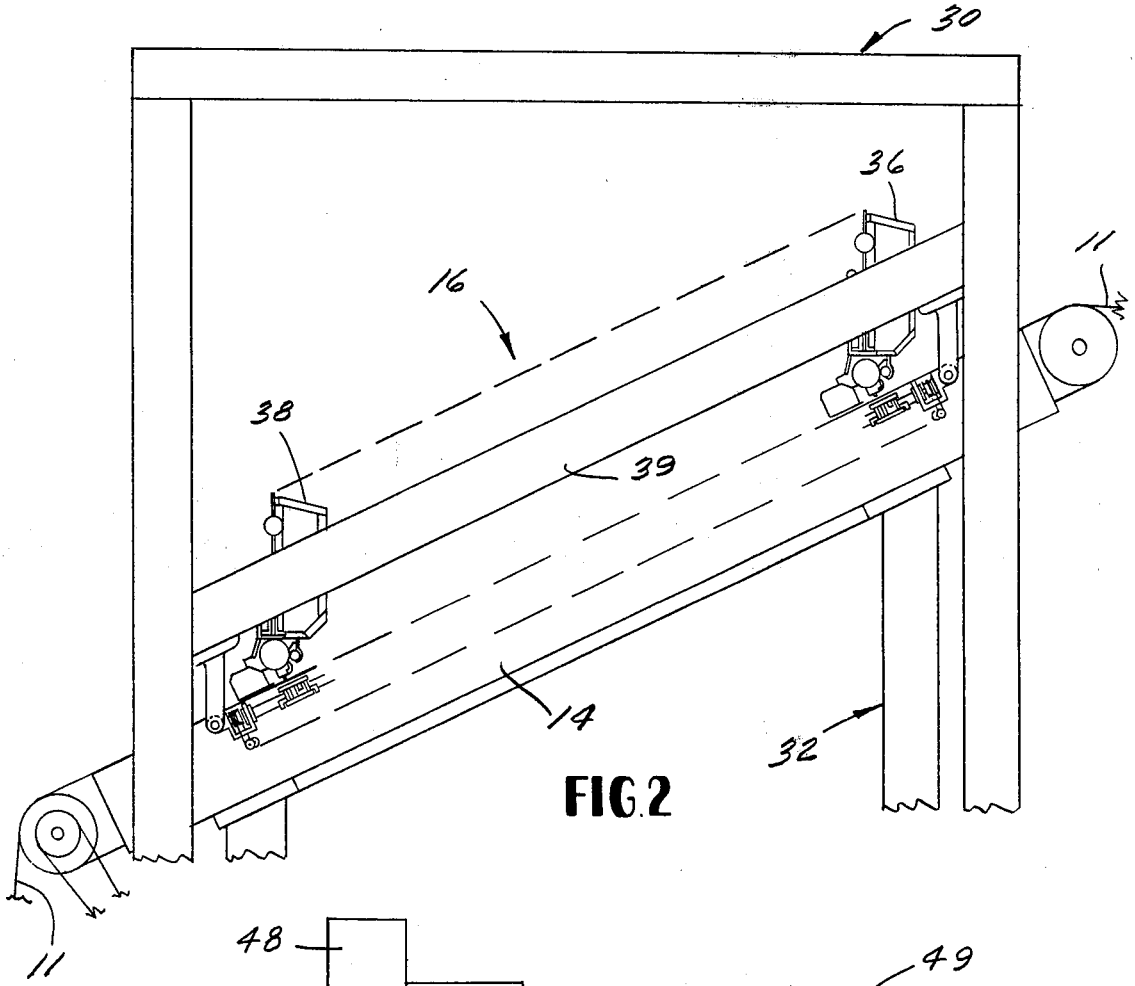
FIG. 2 is an enlarged schematic side elevation, with parts broken away, of the jet dye applicator gun bar section of the apparatus of FIG. 1, showing in more detail the arrangement and relation of the jet gun bars to the conveying means to transport the materials to be printed.

FIG. 2 is an enlarged side elevation, with portions broken away, of the gun bar section 16 and conveyor 14. As seen in both FIGS. 1 and 2, the gun bar section 16 and conveyor 14 are supported on a suitable frame 30 which includes a movable section 32 mounted on rollers 34 (FIG. 1) to permit removal of the conveyor 14 from beneath the gun bar section to facilitate cleaning, repair, and alignment of the gun bars.

As shown, gun bar section 16 includes a plurality of gun bars spaced along the conveyor 14 just above the path of travel of the carpet. Each gun bar is provided with a suitable color dye and is programmed to apply the dye from selected orifices therein to corresponding portions of the surface of the moving carpet. For convenience, only the first and last gun bars 36, 38 of the gun bar section 16 are shown in FIG. 2. The number of gun bars may be varied, as desired, depending on the particular color requirements of the pattern to be applied to the fabric. The gun bars are of substantially identical construction and extend across the conveyor and path of travel of the carpet thereon.

Figure 3:
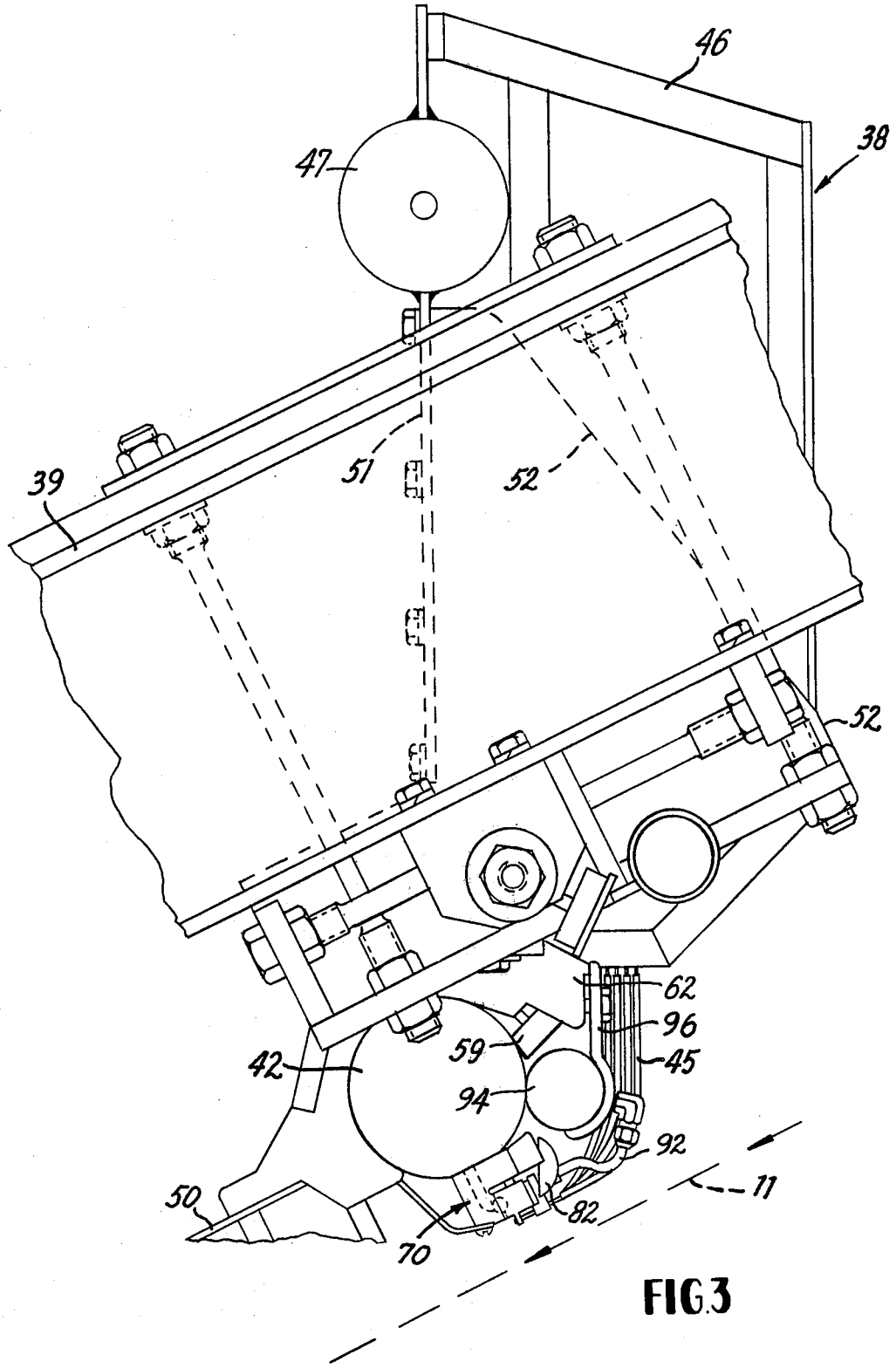
FIG. 3 is a further enlarged side elevation view, with parts broken away showing an individual dye applicator gun bar of the apparatus of FIGS. 1 and 2.

To facilitate disclosure of the construction of the gun bars, the gun bar 38 of FIG. 2 is exemplary and shown in more detail in FIGS. 3–9. As seen in FIG. 3, gun bar 38 is suitably supported by fastening means to a diagonal support beam 39 at each end of the frame 30. The particular mounting means and the method of positionally adjusting the gun bar on the support frame 30 are described and claimed in commonly assigned co-pending U.S. Pat. application Ser. No. 471,109 filed May 17, 1974.

Figure 4:
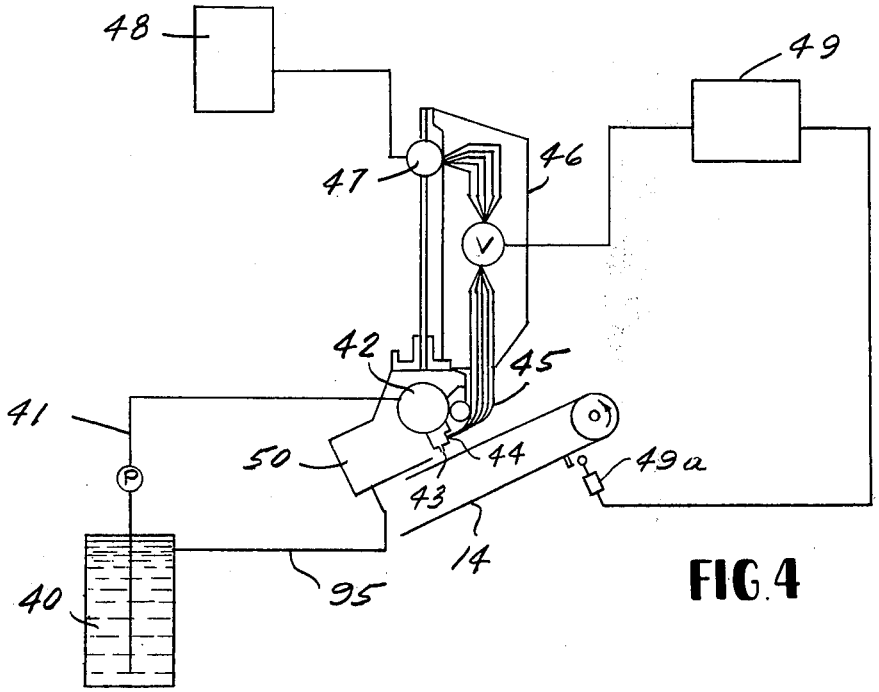
FIG. 4 is a schematic diagram of the system for supplying dye to and from, and air under pressure to, each of the gun bars, together with related control means for programming same.

Each gun bar extends across the width of conveyor 14 transversely to the direction of movement of the carpet and contains a plurality of jet orifices closely positioned along the bar to direct dye in narrow streams toward the surface of the carpet as it passes thereby. As best seen in FIG. 4, each gun bar includes a separate dye reservoir tank 40 which supplies liquid dye by means of pump and conduit means 41 under pressure to a manifold 42 of the gun bar which communicates with the individual jet orifices 43 (shown in greater detail in FIGS. 6*a* and 7– 9). During operation, liquid dye is expelled continuously in small streams or jets from the orifices toward the material to be printed.

Positioned adjacent and at a right angle to the outlet of each jet orifice is an outlet 44 (FIG. 5) of an air supply tube 45, each of which communicates with a separate solenoid valve, illustrated collectively by the symbol V (FIG. 4). The solenoid valves, which are of the electric to fluidic interface type, such as LIF 180D3A12 made by The Lee Company of Westbrook, Conn. are suitably supported on mounting cards in a card housing 46 and are supplied with pressurized air from a communicating manifold 47 and air compressor 48. Although a single valve symbol V is employed for convenience, it is to be understood that a solenoid valve and individual air supply tube is provided to serve each jet orifice of each gun bar such that individual streams of dye can be individually controlled.

The valves are controlled electrically by a pattern control device 49 to normally provide streams of air to impinge against the continuously-flowing dyestreams and deflect the same into a catch basin or trough 50 from which the dye is recirculated to dye reservoir tank 40. The pattern control device 49 for operating the solenoid valves may comprise various conventional control means, such as a computer with magnetic tape transport for pattern information storage. Information from control means 49 is fed to operate the solenoid valves off and on sequentially to print the carpet in a desired pattern as it passes beneath the set of gun bars.

In operation of the presently disclosed apparatus with the pattern control device supplying no information, dye under pressure is continuously supplied in a stream from each jet orifice 43 toward the textile material to be printed. Every solenoid valve is normally open to supply streams of air to impinge against the continuously flowing dye streams and deflect them all into the catch troughs of the gun bars for recirculation. As the first of the carpet to be printed passes beneath the first gun bar and the pattern control device is actuated, as by a trip switch 49*a* on the conveyor, certain of the normally open solenoid air valves are closed so that the corresponding dye streams are not deflected but impinge directly upon the textile material. Thus, by cutting on and off the solenoid air valves in a desired sequence, a printed pattern of dye is placed on the carpet during its passage.

Referring more specifically to the details of the gun bar construction, FIG. 5 is a partial sectional view of a portion of the gun bar of FIG. 3. As seen, the gun bar construction comprises a main vertically disposed structural plate 51 which extends the length of the gun bar across the path of material movement. Each end of the plate is attached by bolts to a triangularly shaped end plate 52, one of which is seen, partially in phantom, in FIG. 3. Each end plate 52 is, in turn, suitably attached to the adjacent diagonal beam 39 of the support frame 30. Integrally fixed to the upper portion of the vertical plate 51, as by welding, is the air supply manifold pipe 47 which extends along the full length of the plate 51 and provides structural stability to the plate 51 generally perpendicular to its longitudinal direction. Angle brackets 56, 58 are fixedly bolted to and extend along the lower edge of plate 51 to form outwardly extending flanges. The dye supply manifold, shown as a pipe 42, is supported by a number of generally C-shaped clamps 62 spaced along the flanged edge of plate 51. The clamps are adjustably attached to the flanged edge of plate 51 by bolts and the manifold pipe 42 is supportably secured in the clamps by wedge fastening member 59. As with the air supply mainfold 47, dye supply manifold pipe 42 extends along the full width of the support plate 51 to provide dye to the jet applicator section of the gun bar, as will be explained.

As seen, the dye supply manifold pipe 42 is circular in shape and has a flattened side portion 66 which receives the jet applicator section 70 of the gun bar. As best shown in FIGS. 7–9, the jet applicator section 70 comprises a first member 72 which extends along the dye supply manifold pipe 42 and is fastened to the flattened face thereof by a plurality of bolts 74, 75 (FIG. 7). Positioned along the length of the flattened face of the pipe 42 are a plurality of passageways or openings 42*a* which communicate with corresponding passageways 76 in member 72 (FIG. 9). Each passageway 76 extends through member 72 and communicates with a semicircular cavity 78 in an outer face of member 72. Secured to the outer face of member 72 by bolt and bridge clamp means 82 is a second applicator member 84 having a corresponding semi-circular cavity 86 matingly engaged with semi-circular cavity 78 to form a dye receiving chamber to receive dye from the manifold pipe 42. One side of the mating face of section 84 is suitably routed or grooved to provide a plurality of side by side small parallel channels which form the dye jet orifices for ejection of dyestuff onto the moving material to be printed. The relationship of the dye orifices 43 and their corresponding pressurized air outlets 44 are best seen in FIGS. 6 and 6*a*.

Cavity 86 of section 84 is also provided with a plurality of dye recirculation passageways 90 (FIGS. 8 and 9) which permit recirculation of the dye to the dye reservoir tank 40 on the upstream side of the jet orifices 43. This recirculates some of the dye through the system and aids in purging air and removing small particles of foreign matter which might tend to clog or disrupt flow of dye through the jet orifices. Passageway 90 communicates by a conduit 92 with a dye recirculation sub-manifold 94 secured to the C-shaped clamp 62 by a bracket 96 (FIG. 7). Sub-manifold 94 is connected by suitable conduit means, not shown, to return the dye to the dye reservoir tank 40. Similarly, the streams of dye emitted from the dye jet orifices 43 which are not to be applied to the textile material to print a pattern thereon are deflected by pressurized air from air outlets 44 to be caught in dye collection trough 50 from which the unused dye is returned by conduit means 95 (FIG. 4) to dye reservoir tank 40.

The first and second members 72 and 84 of the jet applicator section 70 of the gun bar need not be of continuous length throughout the full length of the gun bar and manifold pipe 42. Preferably, to ease construction or manufacturing difficulties, members 72 and 84 are composed of multiple sections positioned end to end along the manifold pipe. For example, the first member 72 may be 18 inches in length while the second member 84 may be composed of sections 6 inches in length placed end to end along the gun bar. Cavities 78, 86 would also be discontinuous along the length of the applicator section to form plural chambers for receiving and distributing dye to the jet orifices. As best seen in FIG. 7, the bolt and bridge clamp 82 are located to urge the second member 84 not only against the mating face of the first section 72 but also in an upward direction toward the flattened face of the manifold pipe. A set screw 84*a* located in the upper face of the second member 84 engages an opposing lower face of the member 72. By adjusting the set screw and the bridge clamp and bolt 82, the faces of the members 72, 84 forming the jet orifices 43 can be accurately aligned. Additionally, a shim element 45*a* (FIG. 8) is positioned between a movable air tube holder 45*b* and the opposing face of the second member 84. By varying the size of the shim 45*a*, the air outlet 44 may be accurately positioned with respect to the jet orifice 43 and held in such position by the bridge clamp means 82.

Thus, it can be seen that by utilizing the dye supply manifold pipe 42 as a structural support member for the jet applicator section 70 of the gun bar, the overall strength of the gun bar is greatly increased and the stability of the gun bar along its length, which in the application of dye to carpets may be conveniently 12 to 15 feet, is improved to permit accurate positioning of the dye jet orifices and uniform application of the dye streams to the material to be printed. Further, by integrally fixing the air supply manifold pipe 47 to the support plate 51 extending across the length of the gun bar, a structural "I-beam" effect can be created to provide further stability to the overall gun bar system.

As briefly described hereinbefore, each of the C-shaped clamps 62 (FIG. 7) supporting the manifold pipe 42 is adjustably attached to the flanged edge of plate 51 by threaded bolts 96–98. The center bolt 97 is threadably received in a flange 99 of the C clamp and abuts the lower edge of plate 51, while the two outer bolts 96, 98 extend through clearance holes in the flange 99 and are threaded into angle brackets 56, 58. Thus, by adjusting these threaded bolts, the position of the dye jet orifices 43 in the applicator section on the manifold pipe may be adjusted along the length of the gun bar. This permits achieving very accurate straightness and alignment of the manifold pipe and thus aids in gaining accurate registry of component color elements to form the desired pattern on the material to be printed.

That which is claimed is:

1. In apparatus for applying dye to a moving material to print a pattern thereon, including means for moving the material in a path of treatment, at least one elongate dye jet gun bar having a plurality of dye-emitting jet orifices positioned along the bar for directing the dye in plural streams onto the material, and support means having support elements positioned on the sides of the path of material treatment for positioning the gun bar across the path; the improvement wherein said gun bar comprises an elongate structural support plate extending across the path of material treatment, means attaching the support plate to said support elements for support thereby, means attached to one elongate edge of said plate for imparting structural stability thereto, an elongate dye manifold pipe having an inlet for receiving dye for distribution and a plurality of dye outlets spaced along its length, means securing the dye manifold pipe along the other elongate edge of said plate for support thereby, an elongate dye applicator section for dispensing dye in plural streams onto the moving material, and means securing said dye applicator section to said manifold pipe for support thereby with the section extending along the length of the manifold pipe and across the path of material treatment, said applicator section including dye receiving chamber means and a plurality of passageways connecting said chamber means with said dye outlets of said manifold pipe, and a plurality of channels in said applicator section communicating said chamber means with outlets forming said plurality of jet orifices for emitting dye onto the moving material.

2. Apparatus as defined in claim 1 wherein said applicator section comprises a first elongate member having a cavity therein attached to said pipe, said connecting passageways being located in said first elongate member communicating with said cavity, a second elongate member having a cavity therein positioned in mating relation with the cavity of said first member to form said dye receiving chamber means, a positionally adjustable air tube holder operatively associated with said second elongate member, and means adjustably connecting said second elongate member and said air support tube holder to said first elongate member.

3. Apparatus as defined in claim 1 wherein said means securing said dye manifold pipe to said plate comprises flange means extending from opposite faces of said plate along said other edge thereof, clamping means for holding said dye manifold pipe, and adjustable means securing said clamping means to said flange means to support and adjustably position said dye manifold pipe.

4. Apparatus as defined in claim 1 wherein said means attached to said one elongate edge of said plate comprises an air supply manifold pipe integrally attached to the edge of said plate to stabilize the plate against forces directed generally perpendicular to its longitudinal axis.

5. Apparatus as defined in claim 4 including means for conducting pressurized air from said air manifold pipe to a point adjacent each of said dye jet orifices in said gun bar applicator section to deflect dye streams emitted by said orifices.

6. Apparatus as defined in claim 5 wherein said pressurized air conducting means includes valve means supportably attached to said elongate support plate for independently controlling flow of pressurized air to each of said points adjacent said dye jet orifices.

7. Apparatus as defined in claim 1 wherein said dye manifold pipe has a substantially circular outer surface, and a portion of the outer surface contacting said dye applicator section is flattened to receive said section thereagainst.

* * * * *